US005447449A

United States Patent [19]

Kaneko

[11] Patent Number: 5,447,449

[45] Date of Patent: Sep. 5, 1995

[54] PRESSURE CONNECTION TYPE CONNECTOR

[75] Inventor: Tetsuya Kaneko, Tokyo, Japan

[73] Assignee: Yamaichi Electronics Co., Ltd., Tokyo, Japan

[21] Appl. No.: 207,020

[22] Filed: Mar. 7, 1994

[30] Foreign Application Priority Data

Mar. 8, 1993 [JP] Japan ..... 5-072932

[51] Int. Cl.[6] ..... H01R 4/24

[52] U.S. Cl. ..... 439/403; 439/259

[58] Field of Search ..... 439/109, 374, 378, 380, 439/391, 395, 401, 402, 403, 692, 259

[56] References Cited

U.S. PATENT DOCUMENTS

| | | | |
|---|---|---|---|
| 4,168,873 | 9/1979 | Luna | 439/391 |
| 4,466,687 | 8/1984 | Frantz | 439/395 |

FOREIGN PATENT DOCUMENTS

| | | | |
|---|---|---|---|
| 2023210 | 11/1971 | Germany | 439/391 |
| 57-53629 | 11/1982 | Japan . | |
| 2034537 | 9/1979 | United Kingdom | 439/391 |
| 2040607 | 1/1980 | United Kingdom | 439/391 |

*Primary Examiner*—Larry I. Schwartz
*Assistant Examiner*—Jill DeMello
*Attorney, Agent, or Firm*—Wenderoth, Lind & Ponack

[57] ABSTRACT

A pressure connection type connector includes a pressure connection type contact comprising first and second pressure connection type terminals arranged in parallel and spaced apart from one another in an axial direction of a cable conductor in a coated cable, and a third pressure connection type terminal located intermediately between the first and second terminals but displaced therefrom in a direction radially of the cable conductor. The coated cable is pressed against the pressure connection type contact by a pressing member so that the coating of the coated cable is pierced through and broken by tips of the first to third terminals, and the conductor of the coated cable is pressed in between the first and third terminals and between the second and third terminals. The tips of the first to third terminals are then inserted into a receiving hole of the pressing member. The wall of the receiving hole includes first and second inclined surface elements. The first inclined surface element is adapted to press the tips of the first to third terminals radially of the cable conductor to thereby cause contracting and closing of the first to third terminals, and the second inclined surface element is adapted to press the tips of the first and second terminals axially of the cable conductor to thereby cause contract and closing of the first and second terminals.

17 Claims, 5 Drawing Sheets

PRESSURE CONNECTION TYPE CONNECTOR

BACKGROUND OF THE INVENTION

1. Field of the Invention

This invention relates to a pressure connection type connector (i.e. connector for press-in connection with conductors), which is capable of achieving an electrical connection under pressure by piercing through and breaking the coating of a coated cable and engaging the core-wire or cable conductor in the coated cable.

2. Prior Art

Japanese Patent Publication No. Sho 57-53629 discloses a pressure connection type connector including a pressure connection type contact comprising first and second pressure connection type terminals which are parallel to one another and are spaced apart in a first (width) direction of the conductor of a coated cable while substantially perpendicular thereto, and a third pressure connection type terminal located intermediately between the first and second pressure connection type terminals in the first direction but displaced from the first and second pressure connection type terminals in a second (thickness) direction perpendicular to the first direction (i.e. in a direction radially of the cable conductor when engaged therewith). In this pressure connection type connector, the coated cable is caused to press against the pressure connection type contact by a pressing member so that the coating of the coated cable is pierced through and broken by tips of the first to third pressure connection type terminals projecting from the coated cable, and the conductor of the coated cable are pressed in between the first and third pressure connection type terminals and between the second and third pressure connection type terminals, respectively, so that the tips of the first to third pressure connection type terminals are inserted into a receiving hole of the pressing member.

However, with continuing tendency toward reducing the pitch arrangement of pressure connection type contacts, reducing the cable conductor thickness and miniaturizing the first to third pressure connection type terminals, it is becoming increasingly difficult to achieve reliable electrical connections with the cable conductor between the first and third pressure connection type terminals and between the second and third pressure connection type terminsl and to obtain a sufficient amount of connecting pressure relative to the cable conductor.

OBJECT AND SUMMARY OF THE INVENTION

It is therefore an object of the present invention to provide a pressure connection type connector in which a reliable electrical connection is assured.

In order to achieve the above object, there is essentially provided a pressure connection type connector including a pressure connection type contact comprising first and second pressure connection type terminals arranged in parallel and spaced apart from one another in an axial direction of a cable conductor in a coated cable (i.e. a first direction), and a third pressure connection type terminal located intermediately between the first and second pressure connection type terminals but displaced therefrom in a second direction radially of the cable conductors. The coated cable is pressed against the pressure connection type contact by a pressing member so that the coating of the coated cable is pierced through and broken by tips of the first to third pressure connection type terminals. The conductors of the coated cable are then pressed in between the first and third pressure connection type terminals and between the second and third pressure connection type terminals so that the tips of the first to third pressure connection type terminals are inserted into a receiving hole of the pressing member. The pressure connection type connector comprises first and second inclined surface elements formed on the wall of the receiving hole of the pressing member. The first inclined surface element is adapted to press the tips of the first to third pressure connection type terminals radially of the cable conductor on the projecting side to thereby cause contracting and closing of the first to third pressure connection type terminals, and the second inclined surface element is adapted to press the tips of the first and second pressure connection type terminals axially of the cable conductor to thereby cause contracting and closing of the first and second pressure connection type terminals.

From another aspect of the present invention, there is provided a pressure connection type connector including a pressure connection type contact comprising first and second pressure connection type terminals arranged in parallel and spaced apart from one another in an axial direction of a cable conductor in a coated cable (first direction), and a third pressure connection type terminal located on intermediately between the first and second pressure connection type terminals but displaced in a second direction radially of the cable conductors. The coated cable is pressed against the pressure connection type contact by a pressing member so that the coating of the coated cable is pierced through and broken by tips of the first to third pressure connection type terminals. The conductors of the coated cable are pressed in between the first and third pressure connection type terminals and between the second and third pressure connection type terminals so that the tips of the first to third pressure connection type terminals are inserted into a receiving hole of the pressing member. The pressure connection type connector comprises first and second inclined surface elements formed on tips of the first to third pressure connection type terminals. The first inclined surface element is pressed radially of the cable conductor by a wall of the receiving hole of the pressing member to thereby cause contracting and closing of the first to third pressure connection type terminals, and the second inclined surface element is pressed axially of the cable conductor by the wall of the receiving hole of the pressing member to thereby cause contracting and closing of the first and second pressure connection type terminals.

DETAILED DESCRIPTION OF THE INVENTION

Figure 1:
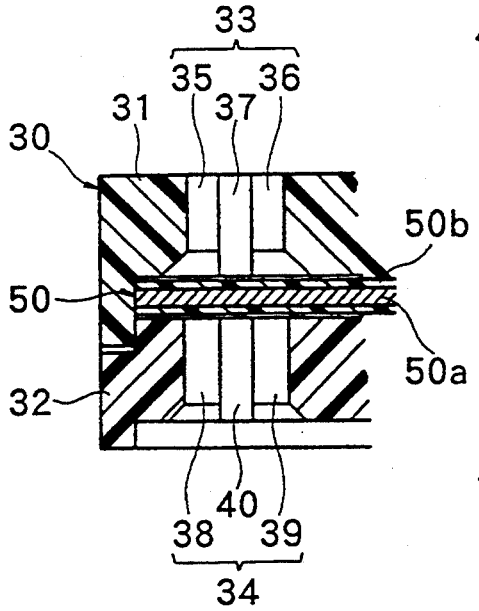
FIG. 1(A) is a cross-sectional view showing an upper abutment plate and a lower abutment plate constituting a pressure member according to one embodiment of the present invention, with a coated cable held between the upper and lower abutment plates.
FIG. 1(B) is a cross-sectional view showing a pressure connection contact implanted in a connector board.
FIG. 1(C) is a bottom face view of a receiving hole formed in the upper abutment plate.
FIG. 1(D) is a bottom face view showing another example of the receiving hole formed in the upper abutment plate.
FIG. 1(E) is a plan view of pointed portions of three pressure connection type terminals in the pressure connection type contact.
FIG. 1(F) is a plan view of another example of the pointed portions of three pressure connection type terminals in the pressure connection type contact.
Figure 1:
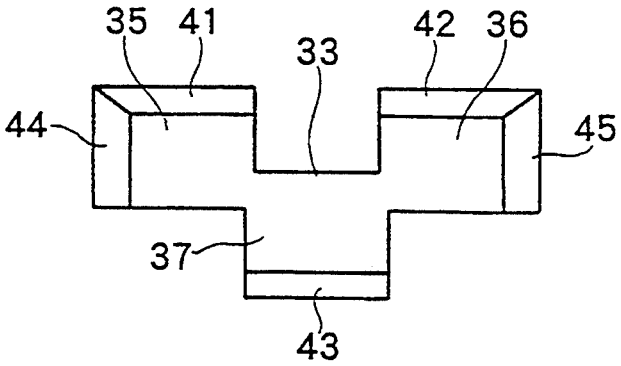
Figure 1:
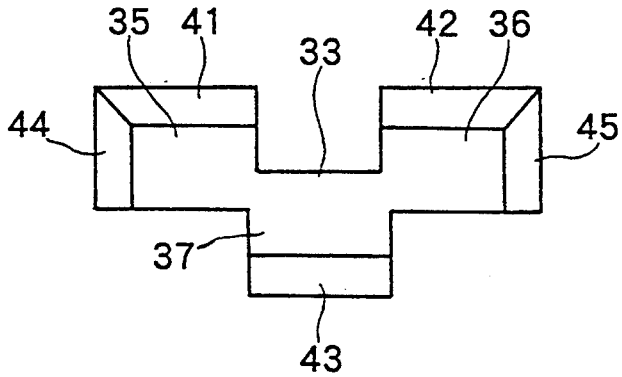
Figure 1:
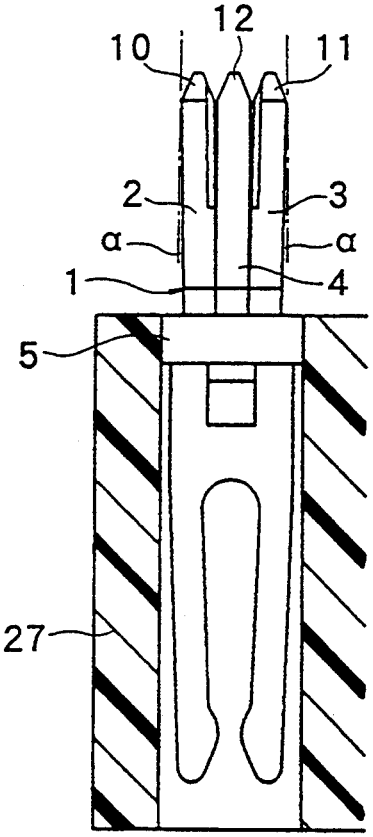
Figure 1:
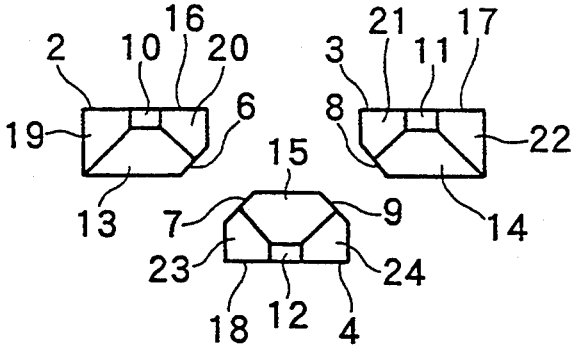
Figure 1:
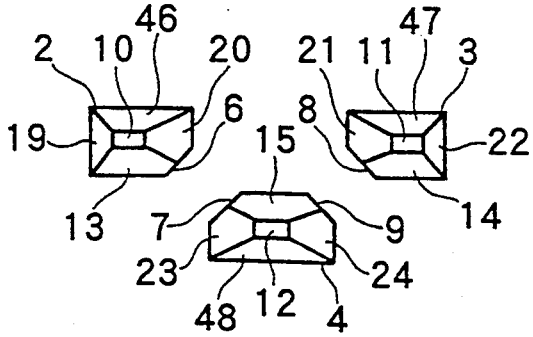
Figure 2:
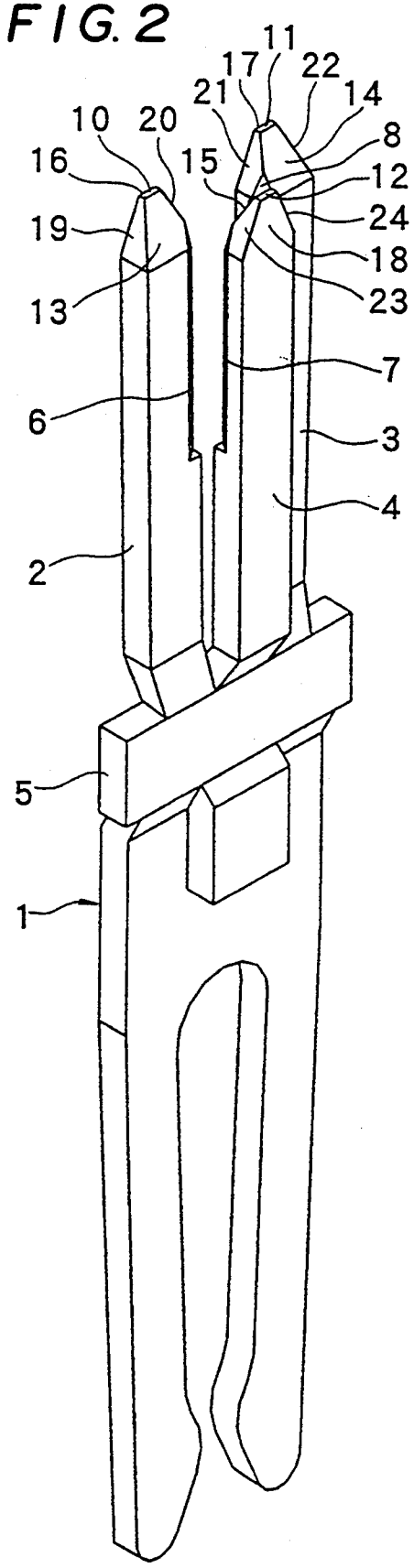
FIG. 2 is a perspective view showing the pressure connection type contact according to the above embodiment.
Figure 3:
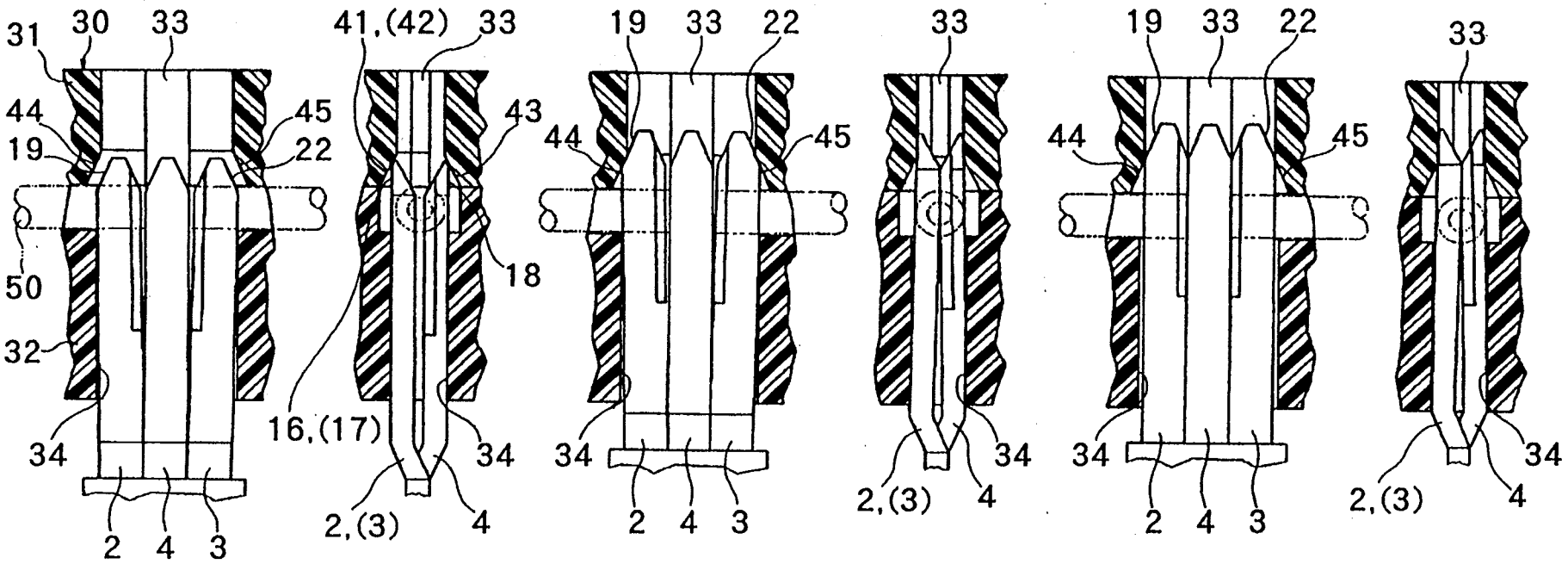
FIGS. 3(A–1) to 3(C–2) are cross-sectional views for explaining the progression of a pressure connection procedure of a coated cable in the above embodiment, FIGS. 3(A–1), 3(B–1) and 3(C–1) are vertical cross-sectional views taken axially of the cable conductor, and FIGS. 3(A–2), 3(B–2) and 3(C–2) are vertical cross-sectional views taken radially of the cable conductor.
Figure 4:
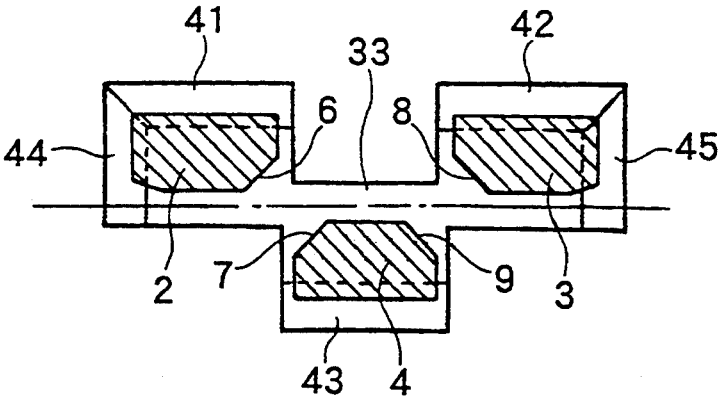
FIGS. 4(A) to 4(C) are plan views for explaining the progression of an insertion procedure of the pressure connection type terminals into a receiving hole in the above embodiment.
Figure 4:
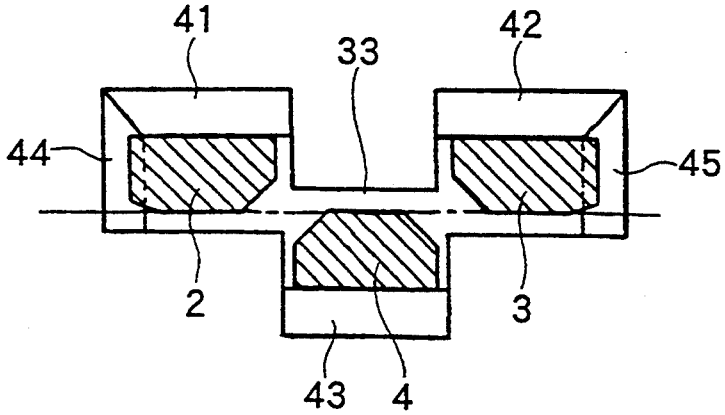
Figure 4:
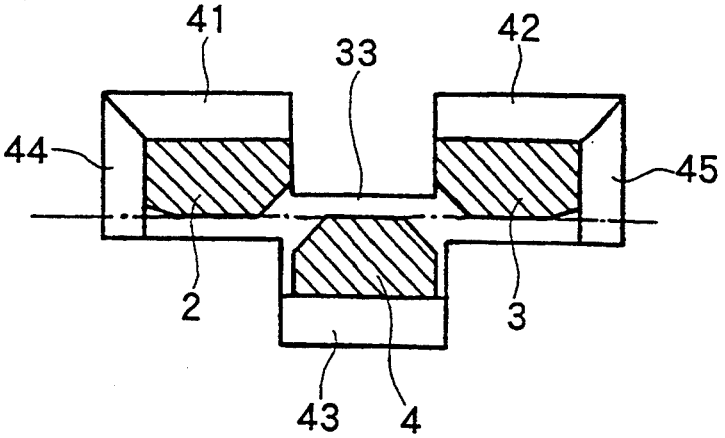
Figure 5:
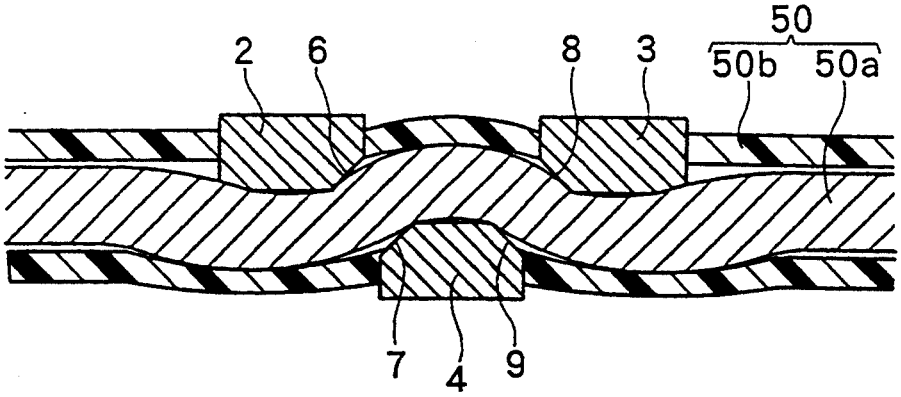
FIGS. 5(A) to 5(C) are lateral cross-sectional views for explaining the progression of a pressure connection procedure of the coated cable in the above embodiment.
Figure 5:
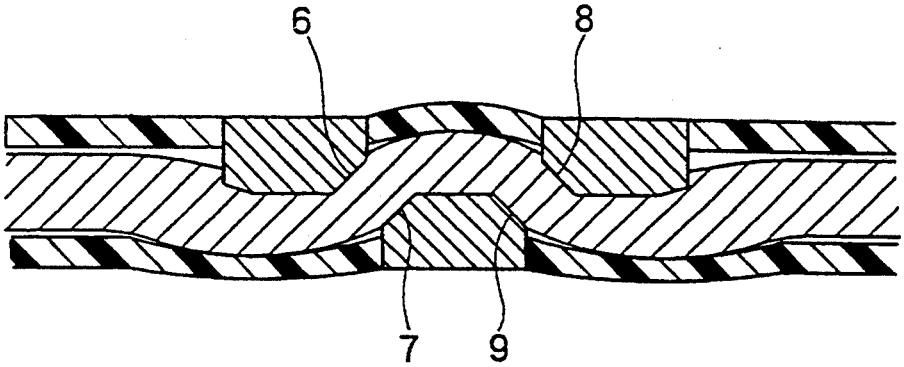
Figure 5:
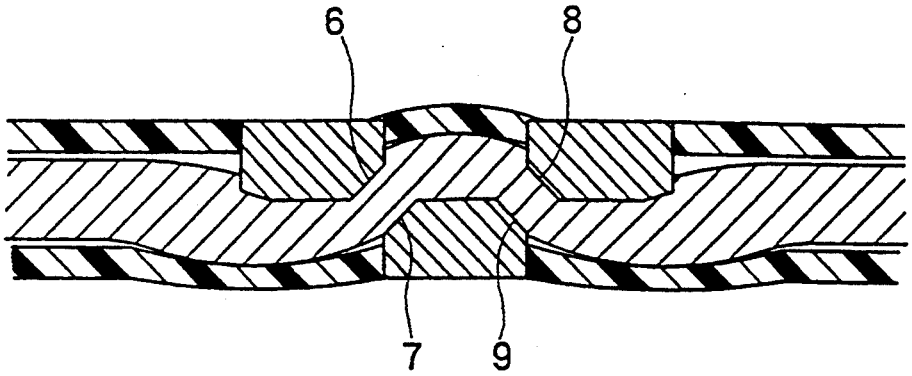

FIGS. 1 to 5 show one embodiment of the present invention. FIGS. 3(A–1) to 3(C–2), FIGS. 4(A) to 4(C) and FIGS. 5(A) to 5(C) respectively correspond to each other with respect to the pressure connection condition.

As shown in FIGS. 1 and 2, a pressure connection type contact 1 comprises first to third prismatic pressure connection type terminals 2, 3 and 4 upstanding in parallel relation to each other from a connecting portion 5. The first to third pressure connection type terminals 2, 3 and 4 are spaced apart from one another along a first (width) direction (i.e. in an axial direction of a cable conductor 50*a* in a coated cable 50 which is to be pressed in the first to third pressure connection type terminals). The third pressure connection type terminal 4 is located intermediate between the first and second pressure connection type terminals 2 and 3 along the first direction, and is displaced from the first and second pressure connection type terminals 2, 3 along a second (thickness) direction perpendicular to the first direction (i.e. in a direction radially of the cable conductor 50*a* when engaged therewith). The first and third pressure connection type terminals 2 and 4 are provided at opposite angular portions thereof with inclined pressure connection surfaces 6 and 7 which extend vertically, and the second and third pressure connection type terminals 3 and 4 are provided at opposite angular portions thereof with inclined pressure connection surfaces 8 and 9 which extend vertically. As shown in FIG. 5(C), the coated cable 50 is pressed in between the first and third pressure connection type terminals 2 and 4 and between the second and third pressure connection type terminals 3 and 4, and a coating 50*b* of the coated cable 50 is pierced through and broken by tips of the first to third pressure connection type terminals 2, 3 and 4, respectively, so that the cable conductor 50*a* is held, under pressure, between the pressure connection surfaces 6 and 7 and between the pressure connection surfaces 8 and 9, respectively.

The first to third pressure connection type terminals 2, 3 and 4 are provided at tips thereof with pointed portions 10, 11 and 12, respectively. The respective pointed portions 10, 11 and 12 include inner inclined surfaces 13, 14 and 15 which are directed inwardly with respect to the second direction (i.e. with respect to a radial direction of the cable conductor), outer vertical surfaces 16, 17 and 18 which are directed outwardly with respect to the second direction (i.e. with respect to the radial direction of the cable conductor), and opposite inclined surfaces 19 and 20, 21 and 22, and 23 and 24, respectively, which face in the first direction (i.e. the axial direction of the cable conductor). As shown in FIG. 1(B), the first and second terminals 2, 3 are inclined outwardly at an angle of $\alpha$ relative to a line perpendicular to the connecting portion 5 so that they gradually diverge toward the tips. This pressure connection type contact 1 is implanted in a connector substrate 27 by pressing the connecting portion 5 into the connector substrate 27.

A pressing member 30 for pressing the coated cable 50 against the pressure connection type contact 1 includes an upper abutment plate 31 and a lower abutment plate 32. The coated cable 50 is correctly positioned and held between the upper and lower abutment plates 31 and 32.

The upper and lower abutment plates 31 and 32 are provided with receiving holes 33 and 34 adapted to receive the first to third pressure connection type terminals 2, 3 and 4 of the pressure connection type contact 1 and arranged so as to corresponding to the first to third pressure connection type terminals. The receiving hole 33 of the upper abutment plate 31 comprises first and second hole portions 35 and 36 adapted to receive the tips side of the first and second pressure connection type terminals 2 and 3, and a third hole portion 37 communicating with the hole portions 35 and 36 and adapted to receive the tip side of the third pressure connection type terminal 4. These first to third hole portions 35, 36 and 37 constituting the receiving hole 33 of the upper abutment plate 31 receive those parts of the first to third pressure connection type terminals 2, 3 and 4 which projects from the coated cable 50, in order to positionally restrict the terminals 2, 3 and 4 on the side of the coating 50*b* from which they project and firmly hold them under pressure. The receiving hole 34 of the lower abutment plate 32 comprises first and second hole portions 38 and 39 adapted to receive the first and second pressure connection type terminals 2 and 3, and a third hole portion 40 communicating with the hole portions 38 and 39 and adapted to receive the third pressure connection type terminal 4. The first to third hole portions 38, 39 and 40 constituting the receiving hole 34 of the lower abutment plate 32 receive those portions of the first to third pressure connection type terminals 2, 3 and 4 which are about to pierce through the coated cable 50, in order to positionally restrict the terminals 2, 3 and 4 on the side of the coating 50*b* into which the terminals 2, 3 and 4 pierce and guide them into a press-in position. The receiving holes 33 and 34 are in alignment with each other when opposite ends of the upper and lower abutment plates 31 and 32 are engaged with each other.

A hole wall of the receiving hole 33 of the upper abutment plate 31 is formed. In other words, inclined guide surfaces 41, 42 and 43, which are provided at inlet sides and converged toward outlet sides of the first to third hole portions 35, 36 and 37, are formed facing angularly outwardly in the second direction (i.e. with respect to the radial direction of the cable conductor). Inclined guide surfaces 44 and 45, which are provided at inlet sides and converged toward the outlet sides of the first and second hole portions 35 and 36, are formed facing angularly outwardly in the first direction (i.e.

with respect to the axial direction of the cable conductor).

The guide surfaces 41, 42 and 43 constitute a first inclined surface element which presses upper edges of the pointed portions 10, 11 and 12, on the vertical surfaces 16, 17 and 18 side, of the first to third pressure connection type terminals 2, 3 and 4 once they have been caused to project from the coated cable 50 due to pressing by the pressing member 30 in a direction radially of the cable conductor. This provides contracting and closing forces to the first to third pressure connection type terminals 2, 3 and 4 (i.e. a first force against the first and second terminal and a second force against the third terminal). The first to third pressure connection type terminals 2, 3 and 4, in turn, contract and close against the cable conductor 50*a* in the radial direction of the cable conductor.

The guide surfaces 44 and 45 constitute a second inclined surface element which presses the inclined surfaces 19 and 22 of the pointed portions 10 and 11 once they have been caused to project from the coated cable 50 due to pressing by the pressing member 30 in a direction axially of the cable conductor. This provides a contracting and closing force to the first and second pressure connection type terminals 2 and 3 (i.e. a third force against the first terminal and a fourth force against the second terminal). The first and second pressure connection type terminals 2 and 3, in turn, contract and close against the cable conductor 50*a* in the axial direction of the cable conductor.

The above-described guide surfaces 41–45 are arranged such that, in the pressing operation, the second inclined surface element starts pressing the first and second pressure connection type terminals 2 and 3 axially of the cable conductor after the first inclined surface element starts pressing the first to third pressure connection type terminals 2, 3 and 4 radially of the cable conductor.

One example of this arrangement is shown in FIG. 1(C), in which the guide surfaces 41, 42 and 43 constituting the first inclined surface element and the guide surfaces 44 and 45 constituting the second inclined surface element are arranged to be different in gradient (angle of inclination), such that the guide surfaces 41, 42 and 43 start pressing the first to third pressure connection type terminals 2, 3 and 4 radially of the cable conductor first and thereafter, the guide surfaces 44, 45 start pressing the first and second pressure connection type terminals 2 and 3 axially of the cable conductor in order to start the contracting and closing action.

Another example of this arrangement is shown in FIG. 1(D), in which the guide surfaces 41, 42 and 43 constituting the first inclined surface element and the guide surfaces 44 and 45 constituting the second inclined surface element are the same in gradient and the timing for starting the pressing operation is differentiated by properly selecting angles of the pressure receiving surfaces of the pointed portions 10, 11 and 12 relative to the guide surfaces 41, 42, 43 and 44.

In this way, it is possible that after the guide surfaces 41, 42 and 43 press the upper ends of the vertical surfaces 16, 17 and 18 of the first to third pressure connection type terminals 2, 3 and 4 radially of the cable conductor to contract and close the first to third pressure connection type terminals 2, 3 and 4 as shown in FIGS. 3(A–1) and 3(A–2), the guide surfaces 44 and 45 press the inclined surfaces 19 and 22 of the first and second pressure connection type terminals 2 and 3 axially of the cable conductor to contract and close the first and second pressure connection type terminals 2 and 3 as shown in FIGS. 3 (B–1) and 3 (B–2).

More specifically, the coated cable 50 is interposed and held in place between the upper abutment plate 31 and the lower abutment plate 32 and then pressed against the pressure connection type contact 1. By doing this, the pointed portions 10, 11 and 12 of the first to third pressure connection type terminals 2, 3 and 4 are inserted in the receiving hole 34 of the lower abutment plate 32 to pierce through and break, as shown in FIGS. 4(A) and 5(A), the coating 50*b* of the coated cable 50 so that the cable conductor 50*a* of the coated cable 50 starts being pressed in between the pressure connection surfaces 6 and 7 and between the pressure connection surfaces 8 and 9, and the pointed portions 10, 11 and 12 of the first to third pressure connection type terminals 2, 3 and 4 projecting from the coated cable 50 start being inserted into the receiving hole 33.

For insertion of the terminals into the receiving hole 33, first, the inclined surfaces 19 and 22 of the pointed portions 10 and 11 of the first and second pressure connection type terminals 2 and 3 are, as shown in FIG. 3(A–1), in non-contacted relation to the guide surfaces 44 and 45 constituting the second inclined surface element, and the upper edges of the vertical surfaces 16, 17 and 18 of the pointed portions 10, 11 and 12 of the first to third pressure connection type terminals 2, 3 and 4 are, as shown in FIG. 3(A–2), in abutment with the guide surfaces 41, 42 and 43 constituting the first inclined surface element so that the pointed portions 10, 11 and 12 of the first to third pressure connection type terminals 2, 3 and 4 are pressed radially of the cable conductor and are thus contracted and closed radially of the cable conductor against the resiliency thereof. In this manner, the distances in the second direction (i.e. the radial direction of the cable conductor) between the pressure connection surfaces 6 and 7 and between the pressure connection surfaces 8 and 9 are reduced as shown in FIG. 4(B), and the pressure connection surfaces 6, 7, 8 and 9 press the cable conductor 50*a* radially inwardly in such a manner as to press against and intimately contact the cable conductor 50*a* as shown in FIG. 5(B).

Then, as shown in FIGS. 3(B–1), 3(B–2), 4(C) and 5(C), the inclined surfaces 19 and 22 of the pointed portions 10 and 11 of the first and second pressure connection type terminals 2 and 3 are brought into abutment with the guide surfaces 44 and 45 constituting the second inclined surface element and are pressed in the first direction axially of the cable conductor, and the pointed portions 10 and 11 of the first and second pressure connection type terminals 2 and 3 are contacted and closed axially of the cable conductor against the resiliency thereof. In this manner, the distances in the first direction (i.e. the axial direction of the cable conductor between the pressure connection surfaces 6 and 7 and between the pressure connection surfaces 8 and 9 are reduced, and the pressure connection surfaces 6 and 9 press the cable conductor 50*a* axially inwardly in such a manner as to press against and intimately contact the cable conductor 50*a*.

In this way, as shown in FIGS. 3(C–1) and 3(C–2), the pointed portions 10, 11 and 12 of the first to third pressure connection type terminals 2, 3 and 4 are introduced into the vertical hole portion of the receiving hole 33 from the upper ends of the first and second inclined surface elements, the respective surfaces connected to the lower ends of the pointed portions 10, 11 and 12 are restricted by the inner surface of the vertical hole portion, and the first to third pressure connection type terminals 2, 3 and 4 maintain the contracting and closing condition in the radial and axial directions of the cable conductor. At this time, the first to third pressure connection type terminals 2, 3 and 4 extend generally in parallel relation to each other.

As a result, the cable conductor 50*a* extends in a zigzag direction between the pressure connection surfaces 6 and 7 and between the pressure connection surfaces 8 and 9, and receives a contracting and closing force radially of the cable conductor. As a result, there can be obtained a reliable pressure connection condition of the contact 1 with the cable conductor.

Also, as apparent from the above description, according to the present invention, the contracting and closing action is provided in both the radial and axial directions of the cable conductor by the first and second inclined surface elements formed on the pointed portions 10, 11 and 12 of the first to third pressure connection type terminals 2, 3 and 4. FIG. 1(F) shows an alternative example in which, in addition to the provision of the inclined surfaces 19 to 24, inclined surfaces 46, 47 and 48 are formed on outer sides, with respect to the second direction (i.e. the radial direction of the cable conductor), of the pointed portions 10, 11 and 12 so as to serve as the first inclined surface element. The inclined surface 19 of the pointed portion 10 and the inclined surface 20 of the pointed portion 10 can serve as the second inclined surface element. In this case, it is possible for the inclined surfaces 46, 47 and 48 constituting the first inclined surface element and the inclined surfaces 19 and 22 constituting the second inclined surface element to be different in gradient so that the first inclined surface element performs its pressing function at a different time than the second inclined surface element. In this case, the inclined surfaces of the receiving hole 33 can also be provided but do not have to be provided.

The coated cable may be either a multi-core flat cable or a single-core round cable.

Also, it is possible that the first to third pressure connection type terminals 2, 3 and 4 are contracted and closed both in the radial and axial directions of the cable conductor by coaction between the inclined surface element of the pressing member 30 and the inclined surface element of the first to third pressure connection type terminals 2, 3 and 4. The terminals can be simultaneously contracted and closed in both the radial and axial directions of the cable conductor, or the contracting and closing of the terminals in the axial direction of the cable conductor can be carried out started first.

As described in the foregoing, according to the present invention, the first inclined surface element presses the three pressure connection type terminals in a second direction radially of the cable conductor to cause contracting and closing of the three pressure connection type terminals in the second direction, and the second inclined surface element presses the first and second pressure connection type terminals in the first direction axially of the cable conductor to cause contracting and closing of the first and second pressure connection type terminals in the first direction. The three pressure connection type terminals, in turn, contract and close against the cable conductor in the radial direction of the cable conductor and the first and second pressure connection type terminals contract and close against the cable conductor in the axial direction of the cable conductor. By these two actions, the fist and third pressure connection type terminals, and the second and third pressure connection type terminals are contracted and closed, respectively, radially and axially of the cable conductor. As a result, there can be obtained a reliable pressure connection condition of the cable conductor and a sufficient amount of pressure connection force against the cable conductor. Thus, this arrangement can properly fulfil the requirements of miniaturization of the pressure connection type terminals and cable conductors.

Also, as mentioned above, the timing for starting the pressing operations is differentiated such that the second inclined surface element starts the pressing operation in the axial direction of the cable conductor after the first inclined surface element starts the pressing operation in the radial direction of the cable conductor. Accordingly, the effect of the connection pressure against the cable conductor can be enhanced.

The present invention is not limited to the above embodiments but many modifications can be made.

What is claimed is:

1. A pressure connection type connector including a pressure connection type contact and a pressing member, said pressure connection type contact comprising first and second pressure connection type terminals arranged substantially in parallel and spaced apart from one another in an axial direction of a cable conductor in a coated cable, and a third pressure connection type terminal located intermediately between said first and second pressure connection type terminals but displaced radially of the cable conductor, the coated cable being pressed against said pressure connection type contact by said pressing member so that the coating of the coated cable is pierced through and broken by tips of said first to third pressure connection type terminals, the conductor of the coated cable is pressed in between said first and third pressure connection type terminals and between said second and third pressure connection type terminals, and the tips of said first to third pressure connection type terminals are inserted into a receiving hole of the pressing member, wherein first and second inclined surface elements are formed on a wall of said receiving hole of said pressing member, said first inclined surface element being adapted to press the tips of said first to third pressure connection type terminals radially of the cable conductor to thereby provide a contracting and closing force to said first to third pressure connection type terminals, and said second inclined surface element being adapted to press the tips of said first and second pressure connection type terminals axially of the cable conductor to thereby provide a contracting and closing force to said first and second pressure connection type terminals.

2. A pressure connection type connector including a pressure connection type contact and a pressing member, said pressure connection type contact comprising first and second pressure connection type terminals arranged substantially in parallel and spaced apart from one another in an axial direction of a cable conductor in a coated cable, and a third pressure connection type terminal located intermediately between said first and second pressure connection type terminals but displaced radially of the cable conductor, the coated cable being pressed against said pressure connection type contact by said pressing member so that the coating of the coated cable is pierced through and broken by tips of said first to third pressure connection type terminals, the conductor of the coated cable is pressed in between said first and third pressure connection type terminals and between said second and third pressure connection type terminals, and the tips of said first to third pressure connection type terminals are inserted into a receiving hole of the pressing member, wherein first and second inclined surface elements are formed on tips of said first to third pressure connection type terminals, said first inclined surface element being pressed radially of the cable conductor by a wall of the receiving hole of said pressing member to thereby provide a contracting and closing force to said first to third pressure connection type terminals, and said second inclined surface element being pressed axially of the cable conductor by the wall of said receiving hole of said pressing member to thereby provide a contracting and closing force to said first and second pressure connection type terminals.

3. A pressure connection type connector as claimed in claim 1, wherein said first and second inclined surface elements are arranged such that said second inclined surface element starts pressing the tips of said first and second pressure connection type terminals axially of the cable conductor after said first inclined surface element starts pressing of the tips of said first to third pressure connection type terminals radially of the cable conductor.

4. A pressure connection type connector as claimed in claim 2, wherein said first and second inclined surface elements are arranged such that said second inclined surface element starts pressing the tips of said first and second pressure connection type terminals axially of the cable conductor after said first inclined surface element starts pressing of the tips of said first to third pressure connection type terminals radially of the cable conductor.

5. A pressure connection type connector comprising:

a pressing member having a contact-receiving hole formed therein, said contact-receiving hole having an inner peripheral wall;

a pressure connection type contact comprising first, second and third elongated pressure connection type terminals disposed substantially parallel to one another and which have base ends and tip ends, respectively, said first and second terminals being spaced apart from one another in a first direction substantially perpendicular to a longitudinal direction of said first, second and third terminals, and said third terminal being disposed between said first and second terminals in said first direction but displaced from said first and second terminals in a second direction substantially perpendicular to each of said first direction and said longitudinal direction of aid first, second and third terminals;

wherein a first inclined surface means is provided for creating a first force in said second direction against said tip ends of said first and second terminals, and a second force, directed opposite and toward said first force, in said second direction against said tip end of said third terminal, when said contact is received in said contact-receiving hole of said pressing member, to thereby tend to cause relative movement of said tip ends of said first and second terminals toward said tip end of said third terminal; and wherein a second inclined surface means is provided for creating a third force in said first direction against said tip end of said first terminal, and a fourth force, directed opposite and toward said third force, in said first direction against said tip end of said second terminal, when said contact is received in said contact-receiving hole of said pressing member, to thereby tend to cause relative movement of said tip ends of said first and second terminals toward one another.

6. A pressure connection type connector as recited in claim 5, wherein said second inclined surface means is operable, when said contact is received in said contact-receiving hole of said pressing member, to begin creating said third and fourth forces against said tip ends of said first and second terminals, respectively, after said first inclined surface means has begun creating said first force against said tip ends of said first and second terminals and said second force against said tip end of said third terminal.

7. A pressure connection type connector as recited in claim 5, wherein said contact-receiving hole of said pressing member has a contact-entrance end; and said first inclined surface means comprises a pair of first inclined surfaces formed on said inner peripheral wall of said contact-receiving hole, said first inclined surfaces facing angularly toward one another and toward said contact-entrance end of said contact-receiving hole.

8. A pressure connection type connector as recited in claim 7, wherein said second inclined surface means comprises a pair of second inclined surfaces formed on said inner peripheral wall of said contact-receiving hole, said second inclined surfaces facing angularly toward one another and toward said contact-entrance end of said contact-receiving hole.

9. A pressure connection type connector as recited in claim 8, wherein said first inclined surfaces are inclined with a different gradient than said second inclined surfaces.

10. A pressure connection type connector as recited in claim 8, wherein said first inclined surfaces are located at axial positions of said contact-receiving hole different than axial positions of said contact-receiving hole at which said second inclined surfaces are located.

11. A pressure connection type connector as recited in claim 5, wherein said contact-receiving hole of said pressing member has a contact-entrance end; and said second inclined surface means comprises a pair of second inclined surfaces formed on said inner peripheral wall of said contact-receiving hole, said second inclined surfaces facing angularly toward one another and toward said contact-entrance end of said contact-receiving hole.

12. A pressure connection type connector as recited in claim 5, wherein said first inclined surface means comprises first inclined surfaces formed on said tip ends of said first, second and third terminals, respectively, said first inclined surfaces formed on said first and second terminals facing away, along said second direction, from said first inclined surface formed on said third terminal.

13. A pressure connection type connector as recited in claim 12, wherein said second inclined surface means comprises a pair of second inclined surfaces formed on said tip ends of said first and second terminals, respectively, and facing away from one another along said first direction.

14. A pressure connection type connector as recited in claim 13, wherein said first inclined surfaces are inclined with a different gradient than said second inclined surfaces.

15. A pressure connection type connector as recited in claim 5, wherein said second inclined surface means comprises a pair of second inclined surfaces formed on said tip ends of said first and second terminals, respectively, and facing away from one another along said first direction.

16. A pressure connection type connector as recited in claim 5, wherein said pressing member comprises a means for pressing a cable, having a conductor and a coating over the conductor, against said contact to cause said first, second and third terminals to pierce through the coating and engage about the conductor.

17. A pressure connection type connector as recited in claim 16, wherein said pressing member comprises an upper abutment plate and a lower abutment plate;

said contact-receiving hole is formed in said upper abutment plate; and another contact-receiving hole is formed in said lower abutment plate in alignment with said contact-receiving hole formed in said upper abutment plate.

* * * * *